US005263221A

United States Patent [19]

Teichelman

[11] Patent Number: 5,263,221

[45] Date of Patent: Nov. 23, 1993

[54] PAINT SCRAPER

[76] Inventor: Emery C. Teichelman, 1800 Granger Rd., Taylor, Tex. 76574

[21] Appl. No.: 818,684

[22] Filed: Jan. 7, 1992

[51] Int. Cl.[5] ..... B44D 3/16

[52] U.S. Cl. ..... 15/236.1; 15/93.1; 29/81.05; 29/81.11

[58] Field of Search ..... 15/93.1, 104.011, 104.03, 15/104.05, 104.09, 104.095, 104.11, 236.10; 29/81.01, 81.05, 81.11

[56] References Cited

U.S. PATENT DOCUMENTS

| | | | |
|---|---|---|---|
| 2,801,432 | 8/1957 | Randrup | 15/93.1 |
| 3,278,964 | 10/1966 | Horelica | 15/104.09 |
| 4,244,072 | 1/1981 | Dunham | 15/104.095 |
| 4,326,317 | 4/1982 | Smith et al. | 15/104.095 |

FOREIGN PATENT DOCUMENTS

| | | | |
|---|---|---|---|
| 350083 | 3/1922 | Fed. Rep. of Germany | 15/104.011 |
| 652911 | 11/1937 | Fed. Rep. of Germany | 29/81.05 |

*Primary Examiner*—Edward L. Roberts

[57] ABSTRACT

A point scraping device having a rotating coil spring which has one end mounted on a rod member having one end adapted to be mounted in a chuck. A rubber core having spring steel wires therein is mounted within the coil spring. The coil spring has rows of lozenge cuts on the surface extending along a substantial portion thereof. A second rod has one end mounted in the other end of the coil spring and has threads on the surface with axially extending slits in the threads. The other end of the second rod is tapered and has cuts extending along the taper.

1 Claim, 3 Drawing Sheets

FIGURE #1
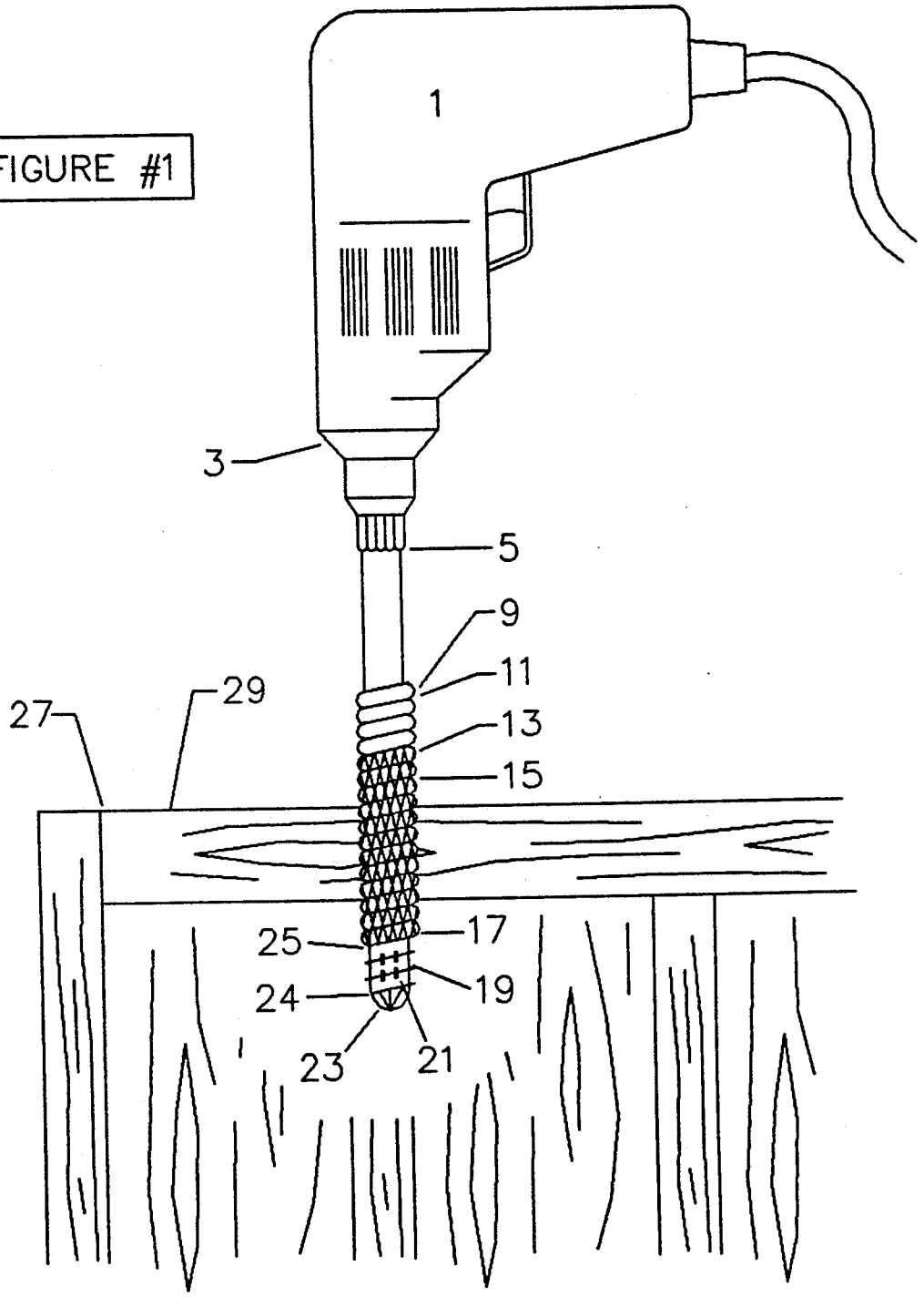

FIGURE #2
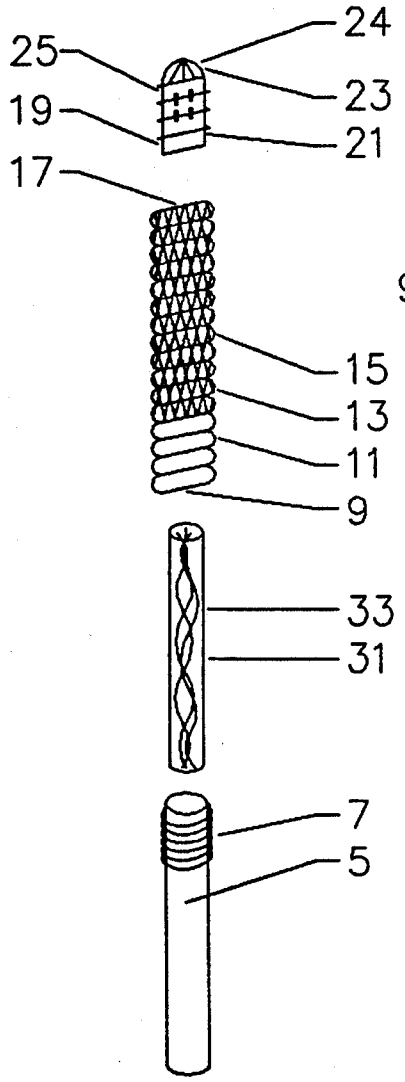
FIGURE #3
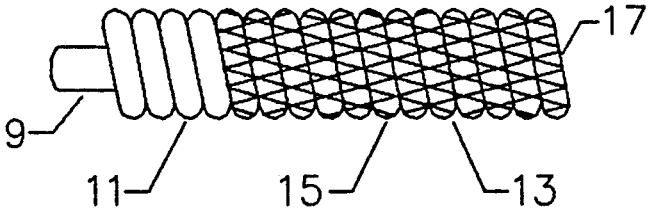
FIGURE #6
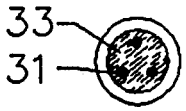
FIGURE #4
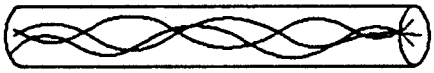
FIGURE #5
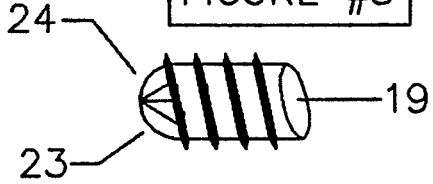

FIGURE #7
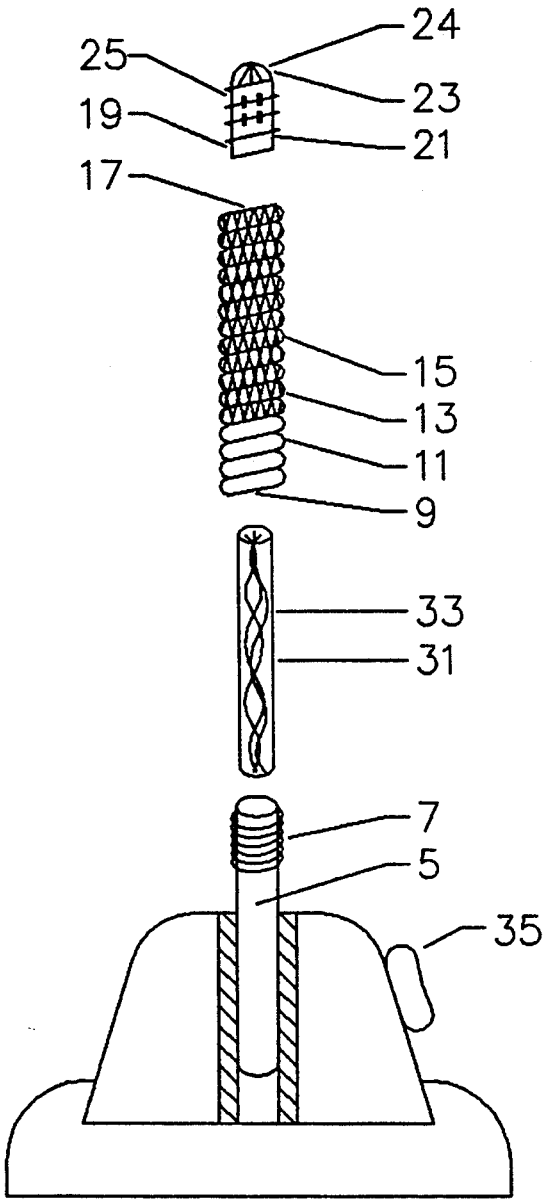

PAINT SCRAPER

BACKGROUND—FIELD OF INVENTION

This invention relates to rotary scraping tool of the type particularly adapted to scrape and remove paint and other coating material from wood surfaces to which such material may be adhered.

BACKGROUND—DESCRIPTION OF PRIOR ART

The problem of scraping paint and other coating from a wood surface to be cleaned is one which has not heretofore been solved satisfactorily.

The use of rotating wire brushes has been employed in the past for scraping paint and other coating from wood structures, such as trim, eaves, louvers, and other wood surfaces—but such brushes are not totally satisfactory. When rotating brushes are employed, it becomes very difficult to maneuver brushes to the area mentioned due to the angle of wood surfaces and also due to the design of the brush tool.

It has also been attempted in the past to employ various tools of rotating sand paper methods and steel wire chipping action, both designed to clean surfaces of different material by impact.

When rotating tool of sand paper is employed, the effect is to smooth out paint instead of removing the necessary paint to complete the work. The cleaning process then becomes one of wearing the paint away by repeated sanding, and the results have not heretofore been satisfactory.

When wire chipping actions are employed, the effect is danger of damage to wood surfaces, and at best removing the paint in uneven fashion. The process of chipping by impact may find some success on other hard surfaces such as metal surfaces and the like. Therefore chipping action on wood surfaces has not been satisfactory.

Neither of these means is designed to engage work in eaves, louvers, or other groove areas with satisfactory results.

OBJECTS AND ADVANTAGES

The main object of the present invention is therefore the provision of a scraping tool for removing paint from wood articles to be cleaned and which tool overcomes the disadvantages of prior art tools of like nature.

Another object of the invention is the provision of a scraping tool which is extremely inexpensive to make and to operate and which may be power driven by a conventional electric hand drill.

Still another object of the invention is the provision of a scraping tool for removing paint, which incorporates a unique scraping rod end designed to remove paint and other coating from grooved articles.

Another object of the invention is the provision of a scraping tool that is substantially flexible in design with a variable amount of scraping friction that can be directly controlled by the hand drill.

Another object of the present invention is the provision of a scraping tool that is flexible in design and adaptable to follow the contour and curvation of the material for scraping paint and other coating material from wood structures, such as trim, eaves, louvers and other wood articles.

Another object of the invention is the provision of scraping tool for removing paint which incorporates a unique scraping body that is extremely safe in operation and light weight.

Another object of the invention is the provision of a scraping tool that would substantially reduce the cost of labor by means of the construction of the present tool.

Other object and advantages will be apparent from the following specifications and from the drawings.

FIG. 1 is a side elevational view of the preferred form of the invention showing the attached in a conventional electric hand drill with the scraping tool illustrated in engagement with the work to be cleaned.

FIG. 2 is a side view of the tool of FIG. 1 showing the various parts of the tool separated for clarity but in their proper relative position.

FIG. 3 is an enlarged elevational view of the scraping element.

FIG. 4 is an enlarged exploded view of rubber core 33 surrounding steel wires 31—FIG. 2.

FIG. 5 is a side elevational view of the scraping end 19.

FIG. 6 is an elevational end view of the rubber core 33 surrounding the steel wires 31.

FIG. 7 is a side view of the scraping tool of FIG. 1-2 showing the method of assembling of the tool in a vise.

DETAIL

In detail the invention is adapted to be mounted on and actuated by a conventional electric hand drill generally designed 1 (FIG. 1) and which drill includes a conventional chuck 3: the present invention included a driving rod 5 (FIG. 1-2-7) which is adapted to be removable but fixedly secured in chuck 3. End 9 (FIG. 1-2-3-7) of spring 13 (FIG. 1-2-3-7), having an inside diameter slightly less than the diameter of rod 5 (FIG. 1-2-7), is adapted to receive therein the end of rod 5 as shown (FIG. 1-2-7), with the spring 13 which is adjacent to rod 5 surrounding the latter and gripping relation therewith.

Secured to the end of driving rod 5 opposite the end adapted to be clamped in chuck 3 (FIG. 1) is one end of spiral threads 7 (FIG. 1-2-7). End 9 of coil spring 13 (FIG. 1-2-3-7) having an inside diameter slightly less than the diameter of rod 5 (FIG. 1-2-7) is adapted to receive therein -the end of rod 5 as shown (FIG. 1-2-7) with the coils of spring 13 that are adapted to rod 5 surrounding the latter and in gripping relation therewith. Adjacent to end rod 19 (FIG. 1-2-5-7) with one end of spiral threads 21 (FIG. 1-2-5-7) end 17 (FIG. 1-2-3-7) of spring 13 (FIG. 1-2-3-7), having an inside diameter slightly less than the diameter of rod 19 (FIG. 1-2-5-7), is adapted to receive therein the end of rod 19 as shown (FIG. 1-2-5-7) with the spring 13 which is adjacent to rod 19 surrounding the latter and in gripping relation therewith.

A transparent rubber core 33 (FIG. 2-4-6-7) surrounding 3 steel wires 31 (FIG. 2-4-6-7), Preferably of the same diameter as driving rod 5, is adapted to receive the end of spring 9 (FIG. 1-2-3-7).

Spring 13 (FIG. 1-2-3-7) with rows of lozenge cuts 15 (FIG. 1-2-3-7) on springs 13 with superimposed slits 26 (FIG. 1-2-3-7) paralleled across lozenge cuts 15.

The present invention includes rod 19 with spiral threads 21 (FIG. 1-2-7), spiral threads having slits 25 (FIG. 1-2-5-7), rod 19 with tapered tip 23 (FIG. 1-2--5-7) with paralleled cuts 24 (FIG. 1-2-5-7).

OPERATION

An important feature of the invention is the results achieved by the flexible scraping element 13 (FIG. 1-2-3-7) permitting the scraping tool to follow various grooves and curvatures of material and to adjust to constant changing condition while engaging in scraping work. The invention requires no large number of tools to assemble which would result in loss of time. In operation the spring 13 being a flexible scraping tool, all positions of engaging work and needed pressure can instantly be applied and controlled by the hand drill against frictional resistance as needed.

In operation and when the driving rod 5 is clamped in chuck 3 of drill 1 and the latter started, the scraping element 13 may be held against the work to be cleaned as seen in FIG. 1, wherein paint 29 on work 27 is indicated.

The final result is that upon rotation of the spring 13 approximately 1100 R.P.M. the paint 29 will be subjected to a sharp scraping action which results in the paint being broken away from the work 27.

To assemble tool only a small vise 35 (FIG. 7) and pliers or any other similar convenient means is needed, since spring is the scraping element, there is no time lost for assembling and adjustment. There are only three parts to assemble, using vise 35 and pliers.

The rod 5 may be gripped between the jaws 35 of a vise as shown in FIG. 7, rubber core 33 surrounding three steel wires 31 may then be gripped by pliers or by any other convenient means and positioned core 33 with the rod 5 and then rotate the core in clockwise direction looking toward the rod end 19 from the drill chuck 3. To assemble scraping spring 13 to rod 5 while rod 5 is positioned in jaws 35 when rotated to rod 5 in a direction opposite to that in which the coils of the spring are wound. It should be noted in the connection that spring 13 is right hand. It must be rotated in a clockwise direction looking toward the rod 5 (FIG. 1) and drill chuck 3.

The same method is used to assemble the rod end into opposite end of spring 13 (FIG. 1-2-3-7). To assemble rod end 19 into end of spring 17 while rod 5 is positioned in jaws of vise 35 in a direction opposite to that in which the coils of the spring are wound, it should be noted in this connection that spring 13 is right hand and must be rotated in a clockwise direction looking toward rod 5 (FIG. 1) and drill chuck 3.

The rods are then secured firmly by pliers, the driving rod 5 may then be clamped in chuck 3 of a right hand drill 1, and the latter started.

The conventionally right hand drill means that the chuck 3 rotates in a clockwise direction looking from the body of drill 1 toward said chuck. The entire tool hereinbefore described will be rotated clockwise looking toward the rod end 19. This will obviously make the spring 13 and rod end 19 grip said rod 19 more tightly; therefore no slipping between said rod end 19 and spring 13 will occur.

SUMMARY

Thus the reader will see that the rotary scraping tool of the invention provides a flexible, lightweight, highly durable device which is inexpensive to Make and operate and which is power driven by a conventional electric hand drill. The tool provides the means by which paint and other coating material may be removed from wood structures, such as trim, eaves, louvers, and other wood articles without excessive pressure by the user and without damage to wood surface.

While the above description contains many specifications, these should not be construed as limitations on the scope of the invention, but rather as an exemplification of one preferred embodiment thereof.

Many other variations are possible. For example, the driving rod can be much longer for better inanueverability and easier scraping in difficult areas of edges and angles of wood surfaces. The rubber core can be replaced by a plurality of steel wires interposed in spring which gives added strength to spring and restricts unnecessary arching when scraping. A tubular sleeve slightly larger than driving rod can be placed between spring and chuck, permitting driving rod to rotate freely. The sleeve can be held with two fingers for complete guided control of scraping spring to difficult areas and add scraping pressure to surface if needed.

Thus the scope of the invention should be determined by the appended claims and their legal equivalents, rather than by the examples given.

I claim:

1. A device for scraping and removing point from a surface, said device comprising; a first cylindrical rod member having one end adapted to be mounted in a chuck for rotation and threads at the other end thereof, a coil spring having an inside diameter slightly less than the diameter of said threaded end of said first rod member and having a first end and a second end, the first end of said spring being mounted on the threaded end of said first rod, said coil spring having rows of lozenge cuts on the surface thereof extending from the second end thereof along a portion of said spring toward said first end, a rubber core having spring steel wires therein mounted within said coil spring, a second cylindrical rod threaded along the length thereof and substantially the same diameter as the threaded end of said first rod, one end of said second rod being mounted in the second end of said coil spring, the other end of said second cylindrical rod being tapered, said tapered end having a plurality of cuts, each cut extending from said threaded portion to the end thereof and the threaded portion of said second cylindrical rod having axially extending slits therein.

* * * * *

UNITED STATES PATENT AND TRADEMARK OFFICE

CERTIFICATE OF CORRECTION

PATENT NO. : 5,263,221

DATED : November 23, 1993

INVENTOR(S) : Emery C. Teichelman

It is certified that error appears in the above-indentified patent and that said Letters Patent is hereby corrected as shown below:

Column 4, line 35, "Point" should read --Paint--.

Signed and Sealed this

Eleventh Day of October, 1994

*Attest:*

*Attesting Officer*

BRUCE LEHMAN

*Commissioner of Patents and Trademarks*